US006412220B1

(12) United States Patent
Lindley

(10) Patent No.: US 6,412,220 B1
(45) Date of Patent: Jul. 2, 2002

(54) UPRIGHT ROTATABLE ARCUATE SAFETY GATE FOR A MEZZANINE LOADING BAY

(76) Inventor: Ian Lindley, Homeland, Whiphill Top Lane, Branton, Doncaster (GB), DN3 3FQ ( * ) Notice: Subject to any disclaimer, the term of this patent is extended or adjusted under 35 U.S.C. 154(b) by 0 days.

(21) Appl. No.: 09/164,251

(22) Filed: Sep. 30, 1998

(30) Foreign Application Priority Data

Oct. 1, 1997 (GB) ..... 9720718

(51) Int. Cl.[7] ..... E06B 3/36
(52) U.S. Cl. ..... 49/40; 49/41
(58) Field of Search ..... 49/40, 41, 68; 109/73

(56) References Cited

U.S. PATENT DOCUMENTS

| | | | | | |
|---|---|---|---|---|---|
| 961,227 | A | * | 6/1910 | Hattersley | 109/59 R |
| 2,864,133 | A | * | 12/1958 | Younger | 49/40 |
| 2,878,054 | A | * | 3/1959 | Linder | 296/24.1 |
| 3,438,599 | A | * | 4/1969 | Welzen | 244/216 |
| 4,030,475 | A | * | 6/1977 | Tronstad | 126/523 |
| 4,150,510 | A | * | 4/1979 | Harrison et al. | 49/388 |
| 4,244,302 | A | * | 1/1981 | Stine | 109/2 |
| 4,348,966 | A | * | 9/1982 | Hastings | 109/2 |
| 4,422,264 | A | * | 12/1983 | Harris | 49/121 |
| 4,475,465 | A | * | 10/1984 | Hastings | 109/2 |
| 4,538,379 | A | * | 9/1985 | Vargo | 49/381 |
| 4,928,429 | A | * | 5/1990 | Colombo | 49/41 |
| 4,936,227 | A | * | 6/1990 | Baker et al. | 105/378 |
| 4,991,347 | A | * | 2/1991 | Takimoto et al. | 49/40 |
| 5,241,789 | A | * | 9/1993 | Vacelet | 49/248 |
| 5,452,547 | A | * | 9/1995 | Baloga et al. | 52/32 |
| 5,546,703 | A | * | 8/1996 | Conway | 49/197 |
| 5,564,238 | A | * | 10/1996 | Ellis | 52/173.2 |
| 5,709,050 | A | * | 1/1998 | Benko | 49/109 |

FOREIGN PATENT DOCUMENTS

| | | | | |
|---|---|---|---|---|
| DE | 71601 | * | 9/1915 | 49/40 |
| DE | 1030550 | * | 5/1958 | 49/40 |
| DE | 18349 | * | 7/1982 | 49/40 |
| FR | 2 354 280 | | 1/1978 | |
| FR | 2 408 703 | | 6/1979 | |
| FR | 2 495 683 | | 6/1982 | |
| FR | 2 601 659 | | 1/1988 | |
| FR | 2 634 249 | | 1/1990 | |
| GB | 884491 | | 2/1959 | |
| GB | 1223699 | * | 3/1971 | 49/41 |
| GB | 2 005 324 | | 4/1979 | |
| GB | 2 041 053 | | 9/1980 | |
| GB | 2 163 322 | | 2/1986 | |
| GB | 2 197 373 | | 5/1988 | |
| IT | 251501 | * | 6/1927 | 49/40 |
| JP | 6185259 | * | 7/1994 | 49/40 |
| SU | 1359431 | * | 12/1987 | 49/41 |

* cited by examiner

*Primary Examiner*—Gregory J. Strimbu
(74) *Attorney, Agent, or Firm*—Jenkins & Wilson, P.A.

(57) ABSTRACT

A mezzanine safety gate for a mezzanine loading bay having a rotatable barrier which is movable between an unloading position and a loading position. The barrier prevents access to the mezzanine loading bay edge when the barrier is in either the unloading or loading position and does not include any overhead restriction or barrier so that loads having a height greater than the height of the barrier can be placed within an interior space of the gate.

23 Claims, 7 Drawing Sheets

UPRIGHT ROTATABLE ARCUATE SAFETY GATE FOR A MEZZANINE LOADING BAY

FIELD OF THE INVENTION

The present invention relates to a safety gate and, in particular, to a safety gate for use at the loading bay entrance of a mezzanine floor.

BACKGROUND ART

Generally, a mezzanine floor loading bay means any floor, having a loading bay which loading bay is accessible from a lower floor by a suitable load evaluating equipment such as a fork lift truck. Such loading bays are common to gain access to mezzanine floors which are frequently used for additional storage. Generally, to prevent operators on the mezzanine floor from falling onto the floor below, a safety gate is provided along the edge of the loading bay. Unfortunately, during repeat loading exercise the safety gate is inevitably left permanently open, increasing the risk to operators working on the mezzanine floor and in and around the loading bay area. Furthermore, the use of the gate is inconvenient for the operator of the fork lift truck who must wait until the gate is opened, either by an operator or by suitable electronic equipment before delivering the load to the loading bay. Furthermore, in the former case, the operator opening the gate is also at further risk as it is necessary for the operator to approach the vicinity of the drop whilst opening the gate.

SUMMARY OF THE INVENTION

According to a first aspect of the present invention there is provided a safety gate for a mezzanine loading bay operable to have an open and a closed position, wherein the safety gate is upright and includes barrier means providing an upright barrier and which prevents access to the mezzanine loading bay edge when the gate is in the open position and wherein the ends of the barrier means are spaced apart to provide, in use, a barrier area opening into the loading bay area.

Preferably, the barrier remains upright during movement from the open to the closed position.

Preferably, the barrier remains upright during movement from the closed to the open position.

Advantageously, unlike prior art devices the upright barrier does not include any overhead restriction or barrier so that no limit on the vertical height of the load that may be received in the loading bay area is imposed by the safety gate.

Preferably, the barrier means also prevents access to the mezzanine floor edge when the gate is in the closed position.

Preferably, the barrier means are shaped to partially enclose the loading bay.

Preferably, the barrier means take a substantially arcuate form.

Preferably, the upright safety gate includes rotating means to rotate the barrier means and the barrier area opening between the loading and unloading positions.

In accordance with the above invention, the barrier area opening is generally positioned at the mezzanine opening for off-mezzanine load delivery into the area defined by the barrier means. Thereafter, the barrier is rotated so that the opening is positioned for access for on-mezzanine level unloading and, simultaneously, the upright barrier means is rotated across the mezzanine opening to prevent access thereto by personnel. Once on-mezzanine level unloading is complete, the barrier means may be rotated back ready to receive an off-mezzanine load.

The term mezzanine should be understood in a broad sense to define a split level where loads may be received from a lower level, or possibly, an upper level and, accordingly, the invention may be utilised in any loading area where operator access to the edge of the loading area is to be restricted to prevent personnel falling.

Commonly, however, the invention will have utility where fork lift trucks are used to deliver loads, via a loading bay, to higher level storage areas and where there is a risk of personnel falling off the edge of the loading bay onto the lower level. For instance, the invention is particularly suited to use at the edge of the loading platform of a steel scaffold structure, such as would be used during construction or refurbishment of a building and where it is necessary to lift pallets of material to various levels, as the construction progresses, using a telescopic jib fork truck or similar device.

Preferably, the rotating means comprises a suitable mechanism to rotate the upright gate between the closed and open position. Preferably, when the barrier means is in arcuate form, the safety gate rotates about a central vertical axis of symmetry. Preferably, to maximise the available loading bay area, the said suitable mechanism does not impinge upon the loading bay.

Accordingly, in one embodiment of the invention, the mechanism is located off to one side of the loading bay, wherein the upright barrier means rotates through an arrangement of fixed bearings which define the path through which the barrier travels. Preferably, the barrier means is mounted on a pair of wheels, preferably, castor wheels, to assist the rotary movement. Preferably, the arrangement of bearings is housed in a framework which may also provide an additional barrier perpendicular to the loading bay edge. A complimentary barrier may also be present on the opposite side of the loading bay so that operator access is restricted to the side facing the loading bay edge but spaced therefrom by the safety gate. In this manner, the operator may only gain access to the loading bay area after the gate has been rotated into the closed position so that the opening between the ends of the barrier means is accessible to the operator on the mezzanine level.

BRIEF DESCRIPTION OF THE DRAWINGS

Embodiments of the invention will now be described, by way of example, with reference to the accompanying drawings in which.

DETAILED DESCRIPTION OF THE INVENTION

Figure 1A:
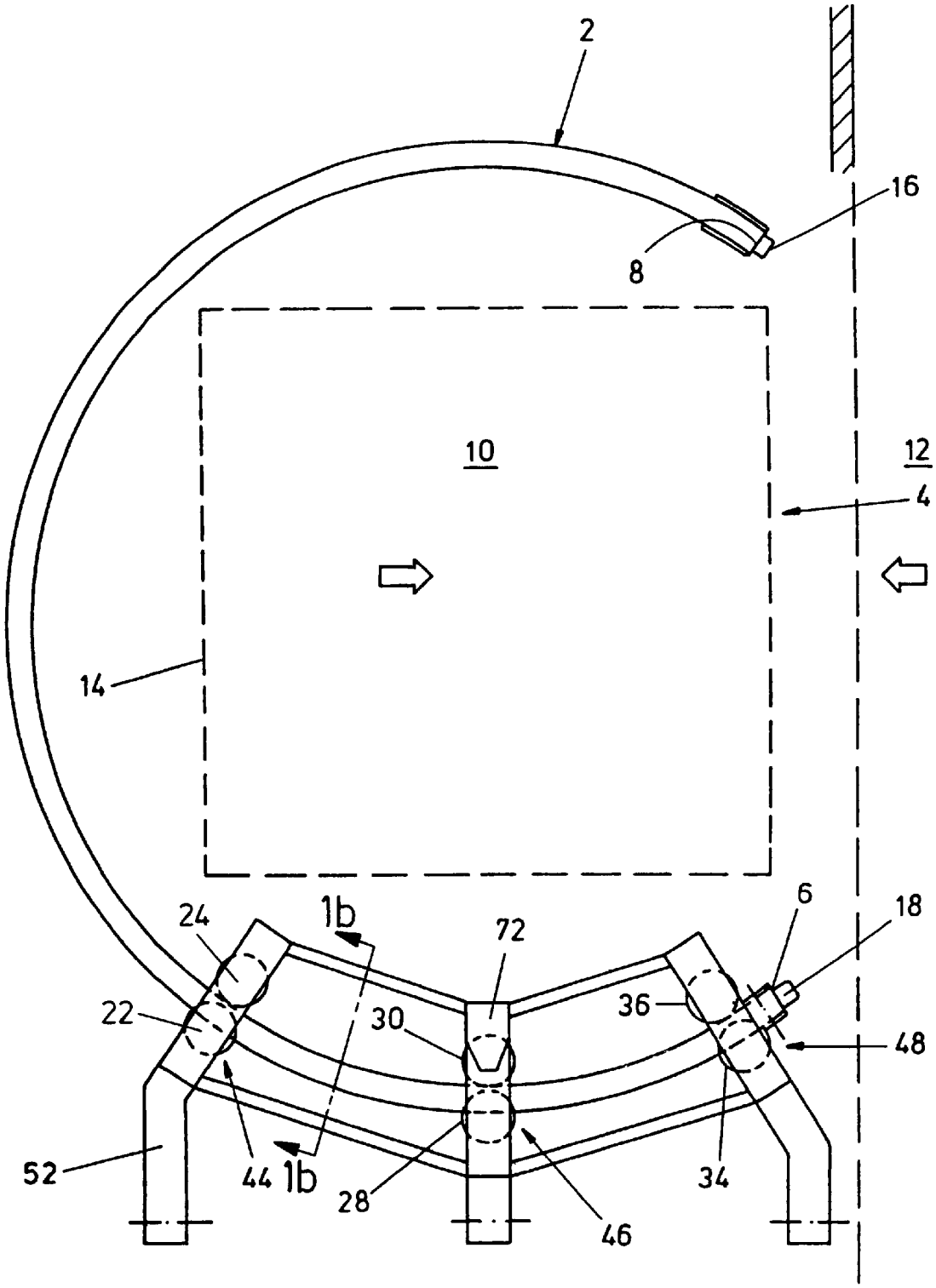
FIG. 1*a* shows a plan view of a safety gate in accordance with the present invention.

Referring to FIG. 1*a,* a safety gate 2 extends in an arc through approximately 260° to partially enclose a loading bay area and to simultaneously provide an opening into the area defined by the arc. The opening 4 is defined by the spaced ends 6, 8 of the arcuate gate 2 and, in the position shown in FIG. 1*a,* accommodates access to the mezzanine loading bay area 10 from the lower level 12. In this manner, a loading device (not shown) such as a fork lift truck may deliver a load 14 onto the mezzanine loading area 10 from the lower level 12.

The gate 2 is mounted on a pair of castors 16, 18 each located at the respective spaced ends 6, 8 of the safety gate 2. Additionally, the safety gate 2 is supported by a series of bearing castors 20, 22, 24, 28, 30, 34, 36. Generally, the bearing arrangement is designed to guide and support the arcuate form of the gate barriers 40, 42. The castor bearings are separated into three complimentary support areas 44, 46 and 48 and this is more clearly seen in the end section shown in FIG. 1*b* which shows the first support area incorporating castors 20–24.

Figure 1B:
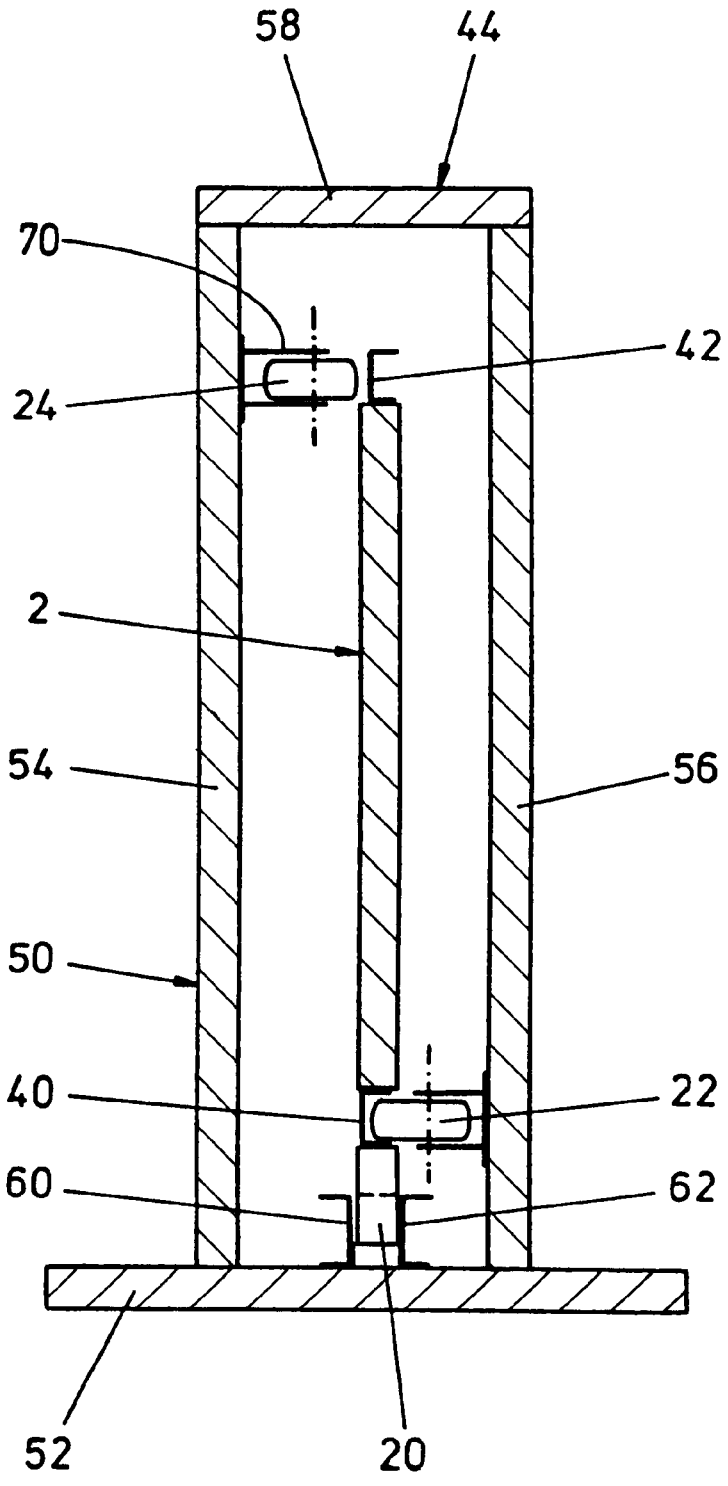
FIG. 1*b* shows a side view of a rotating mechanism in accordance with the present invention.

Referring to FIG. 1*b,* a support frame 50 has a base member 52, two spaced parallel upright members 54, 56 and a cross member 58 welded across the top of the upright members, 54, 56. The base member 52, upright members 54, 56 and the cross member 58 define a rectilinear opening through which the gate 2 passes. A base castor 20 is journalled in a spaced pair of brackets 60, 62 which are mounted on the base member 52 so that the castor provides base support for the gate 2 as it rolls thereover. The gate is guided in its arcuate path by a pair of vertically spaced opposed castors 22, 24 which are journalled in brackets mounted on respective side members 56, 54 so that lateral movement of the barrier with respect to the side members is prevented. The arrangement of bearings is mirrored in support area 48 and partially mirrored in support area 46 save that the base bearing is substituted by a top bearing (not shown) which depends from the cross member 72 by a suitable bracket so that the castor abuts against the top of the barrier 42 and together with base support bearing 20 and a corresponding bearing in area 48 (not shown) provides three point vertical support for the safety gate 2.

Additional support is provided by the track shaped cross-section of the barriers 40, 42 which provide a stable track for the lateral support castors 22, 28, 34 which extend into the track during arcuate movement of the gate 2.

Referring to FIGS. 2–6, a schematic view of a mezzanine 80 and ground floor 82 is shown. The edge 84 of the mezzanine level 80 is fitted with hand rails 86, 88 which respectively terminate on either side of the loading bay 90. Complimentary hand rails 92, 94 each extend from the ends 96, 98 of the edge hand rails 86, 88 at either side of the loading bay 90, to terminate at the operator zone 100 at the opposite side to the loading bay mezzanine edge.

Figure 2:
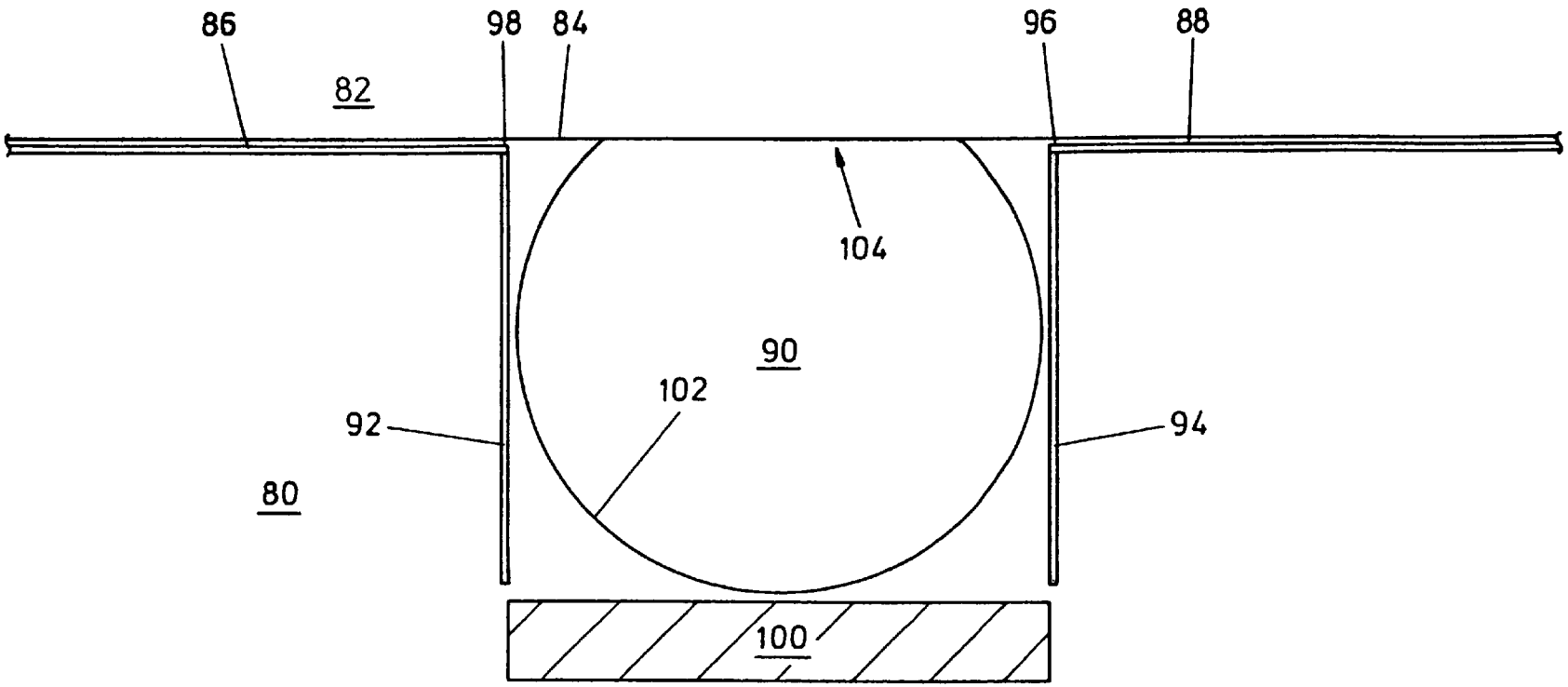
FIG. 2 is a schematic diagram of a method of use of a safety gate in accordance with the present invention wherein the safety gate is shown with the open side of the arcuate safety gate coincident with the mezzanine edge.

An arcuate safety gate 102 according to the present invention is fitted in the loading bay 90 and extends through approximately 260°. In FIG. 2, the gate is shown with the open side 104 of the arcuate safety gate 102 coincident with the mezzanine edge 84.

Figure 3:
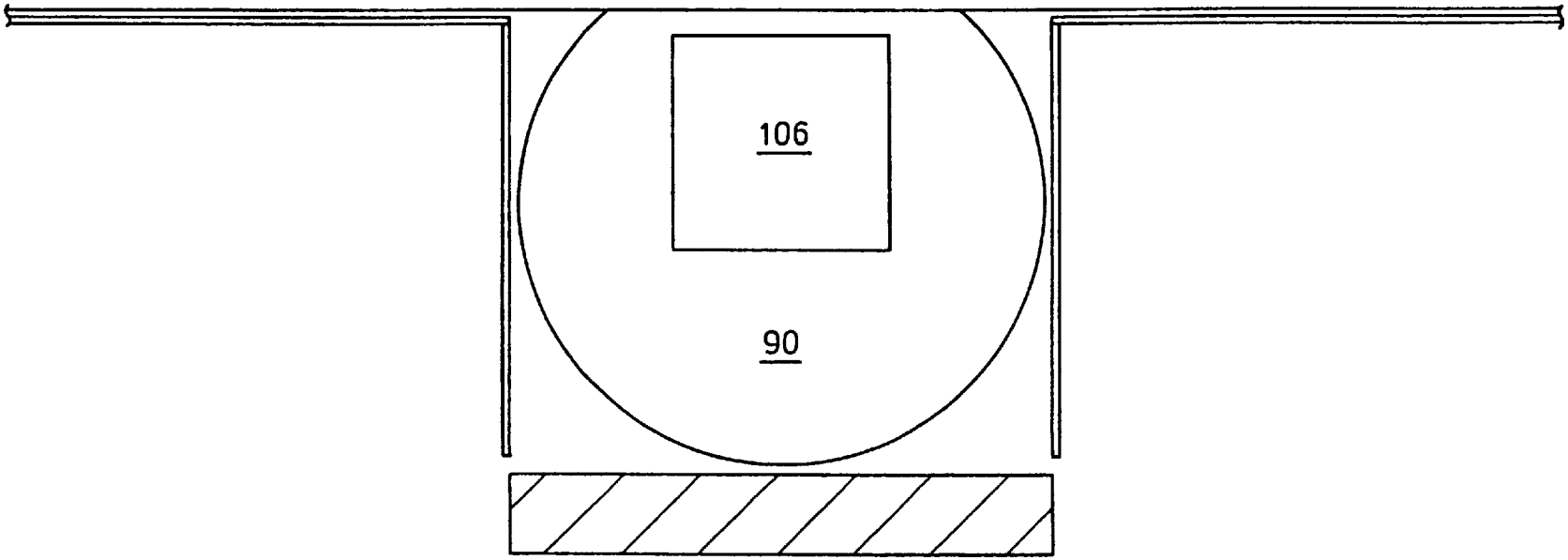
FIG. 3 is a schematic diagram of the method of use of a safety gate in accordance with the present invention wherein a pallet is loaded onto the loading bay.

The pallet 106 supported on the forks of a fork lift truck (not shown) may be elevated by the forks of the truck and loaded onto the loading bay 90 after passing through the opening 104 in the safety gate 102 as shown in FIG. 3.

Figure 4:
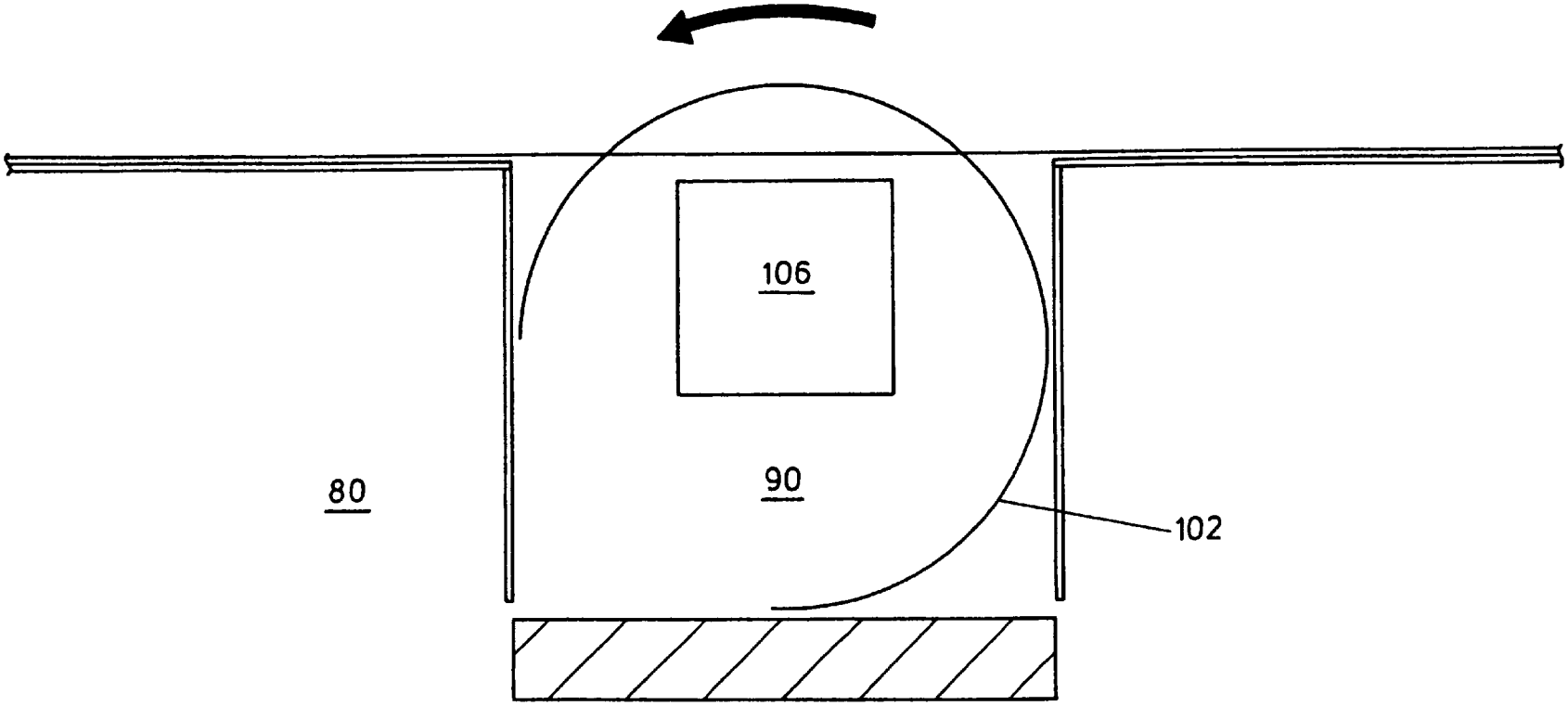
FIG. 4 is a schematic diagram of the method of use of a safety gate in accordance with the present invention wherein the safety gate is rotating toward the operator zone after loading the pallet.
Figure 5:
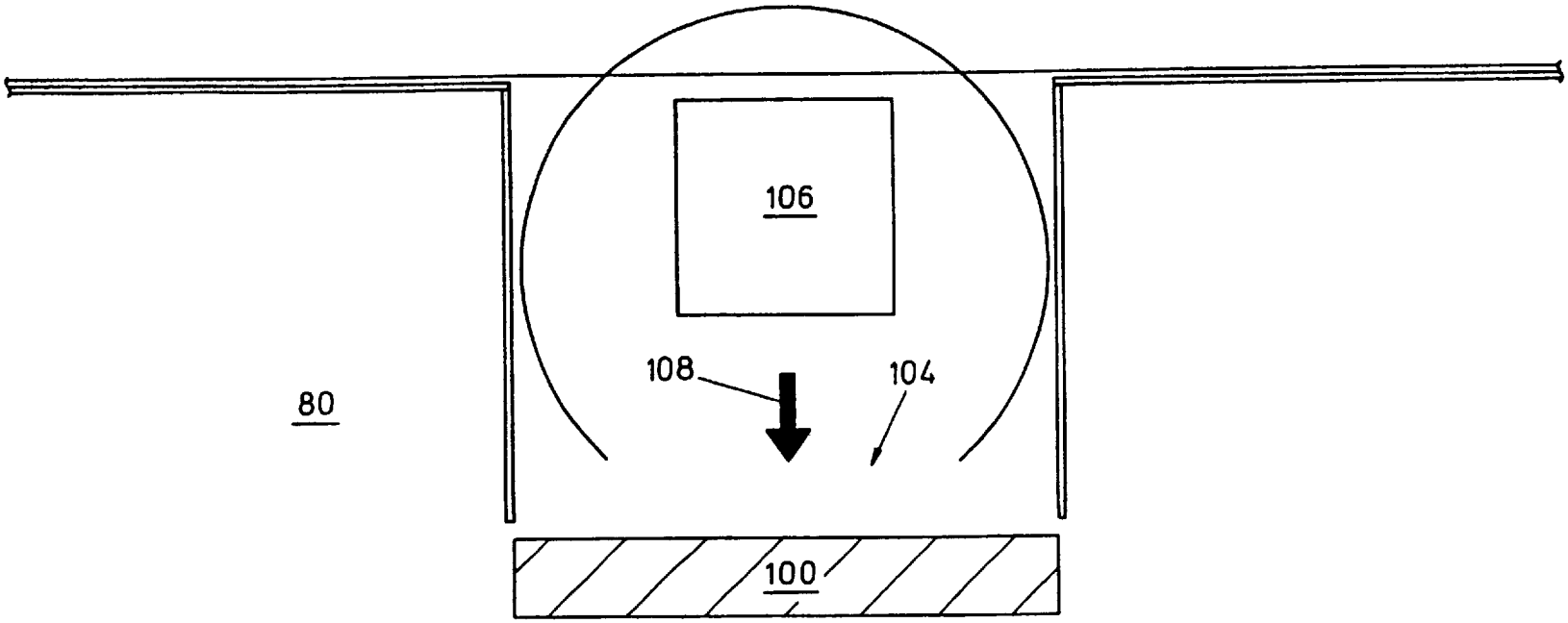
FIG. 5 is a schematic diagram of the method of use of a safety gate in accordance with the present invention wherein the safety gate is rotated through 180° until the opening resides adjacent to the operator zone after loading the pallet.
Figure 6:
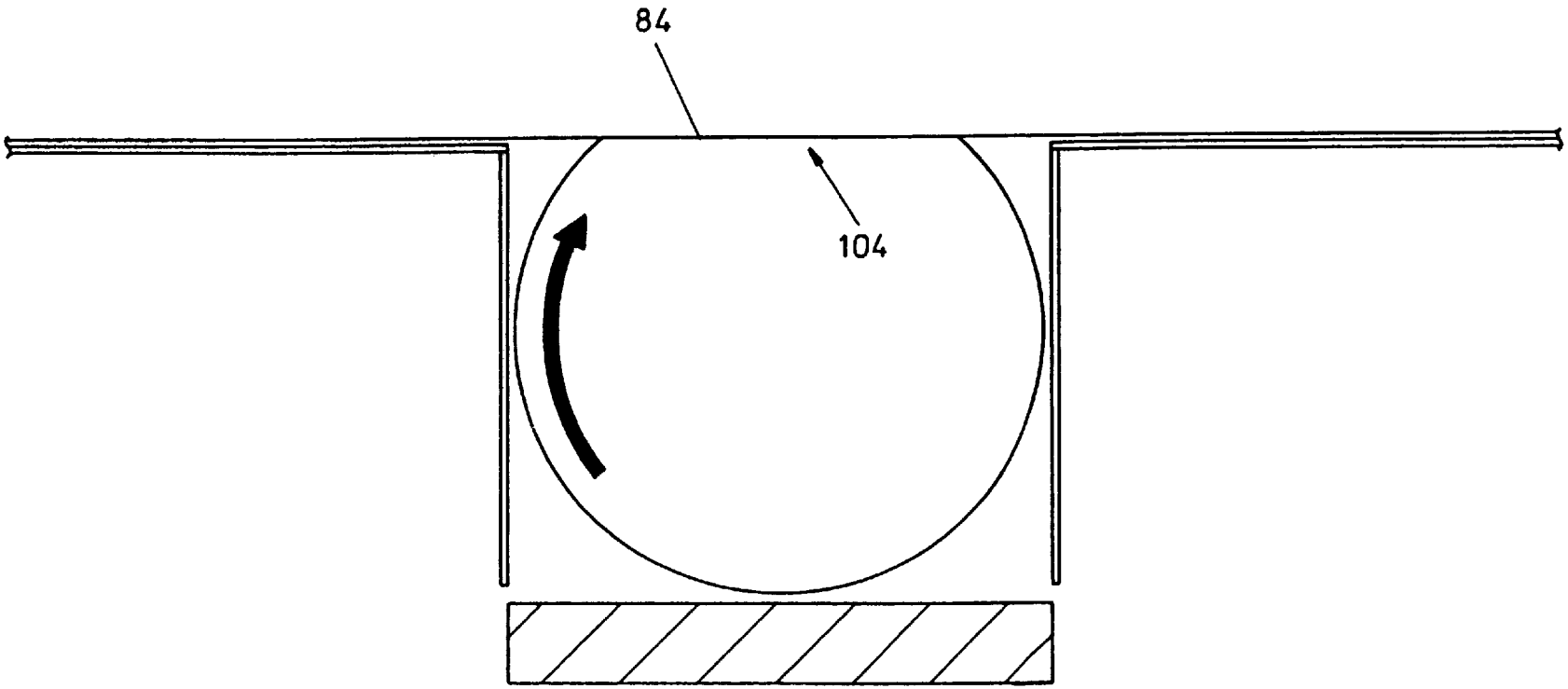
FIG. 6 is a schematic diagram of the method of use of a safety gate in accordance with the present invention wherein the safety gate is rotated through 180° until the opening of the safety gate resides adjacent to the mezzanine edge.

Referring to FIG. 4, after the pallet has been loaded into the loading bay 90, safety gate 102 may be rotated through 180° until the opening 104 resides adjacent to the operator zone 100 so that the load 106 may be removed in the direction of the arrow 108 by appropriate lifting equipment located on the mezzanine floor 80. Thereafter, the gate may be rotated back through 180° so that the opening 104 is once more adjacent to the mezzanine edge 84.

By virtue of the invention, it is not possible for the operator to approach the mezzanine edge of the loading bay area. Furthermore, by leaving the gate in the position shown in FIG. 6 it is possible for a load to be safely received when an operator is not present on the mezzanine floor, thus, improving the efficiency of the loading operation for the operator of the loading device on the ground floor whilst maintaining safety and denying access to the mezzanine floor edge of the loading bay by a mezzanine floor operator.

It is envisaged that alternative embodiment to the invention may have barriers which are other than arcuate but which nevertheless describe a loading area. Generally, the mechanisms for opening, closing and rotating the gate may be suitably automated.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. A safety gate for a mezzanine loading bay comprising:

(a) a support frame having an inside support frame perimeter;

(b) a barrier member supported by the support frame in movable engagement therewith and alternately rotatable about a substantially vertical axis between an open position and a closed position of the safety gate, the barrier member having an inside barrier member perimeter, wherein the inside support frame perimeter and the inside barrier member perimeter define an open interior space of the safety gate;

(c) the barrier member including an uppermost edge defining a top opening of that safety gate, wherein the top opening provides unobstructed access into the safety gate interior space for transport of a load into the safety gate interior space; and (d) wherein the safety gate does not include any structure disposed above the safety gate interior space.

2. A safety gate according to claim 1, wherein the barrier member terminates at a first end and a second end laterally spaced from the first end, the first and second ends defining a lateral barrier opening therebetween.

3. A safety gate according to claim 2, wherein the lateral barrier opening is adapted to be in open communication with the loading bay.

4. A safety gate according to claim 1, wherein the barrier member is adapted to partially enclose the loading bay.

5. A safety gate according to claim 1, wherein the barrier member has a substantially arcuate form.

6. A safety gate according to claim 1, wherein the barrier member remains upright throughout movement between the open position and the closed position.

7. A safety gate according to claim 1, wherein the support frame includes a rotating assembly disposed in operative engagement with the barrier member and is adapted to rotate the barrier member without obstructing access into the safety gate interior space.

8. A safety gate according to claim 1, wherein the substantially vertical axis comprises a central vertical axis of symmetry with respect to the barrier member.

9. A safety gate according to claim 1, wherein the barrier member rotates through an arrangement of bearings which define a path through which the barrier member travels.

10. A safety gate for a mezzanine loading bay comprising:

(a) a support frame having an inside support frame perimeter;

(b) a barrier member supported by the support frame in movable engagement therewith and alternately rotatable about a substantially vertical axis between an open position and a closed position of the safety gate, the barrier member having an inside barrier member perimeter, wherein the inside support frame perimeter and the inside barrier member perimeter define an open interior space of the safety gate; and (c) a rotating assembly disposed in operative engagement with the barrier member and mounted to the support frame, wherein the rotating assembly is disposed laterally in relation to the barrier member and the safety gate interior space and the safety gate does not include any structure disposed above the safety gate interior space.

11. A safety gate according to claim 10, wherein the rotating assembly is adapted to rotate the barrier member without obstructing access into the safety gate interior space to enable transport of a load into the safety gate interior space.

12. A safety gate according to claim 10, wherein the barrier member terminates at a first end and a second end laterally spaced from the first end, the first and second ends defining a lateral barrier opening therebetween.

13. A safety gate according to claim 10, wherein the barrier member is adapted to partially enclose the loading bay.

14. A safety gate according to claim 10, wherein the barrier member has a substantially arcuate form.

15. A safety gate according to claim 10, wherein the barrier member remains upright throughout movement between the open position and the closed position.

16. A safety gate according to claim 10, wherein the rotating assembly includes a bearing arrangement.

17. A safety gate according to claim 10, wherein the substantially vertical axis comprises a central vertical axis of symmetry with respect to the barrier member.

18. A safety gate according to claim 10, wherein the barrier member rotates through an arrangement of bearings which define a path through which the barrier member travels.

19. A safety gate for a mezzanine loading bay comprising:

(a) a support frame having an inside support frame perimeter;

(b) a barrier member supported by the support frame and having an inside barrier member perimeter, wherein the inside support frame perimeter and the inside barrier member perimeter define an open interior space of the safety gate;

(c) the barrier member including an uppermost edge defining a top opening of the safety gate, the top opening providing unobstructed access into the safety gate interior space; and (d) a rotating assembly mounted to the support frame in operative engagement with the barrier member and adapted to rotate the barrier member about a substantially vertical axis between an open position and a closed position of the safety gate without obstructing access into the safety gate interior space, wherein the safety gate does not include any structure disposed above the safety gate interior space.

20. A safety gate according to claim 19, wherein the rotating assembly is disposed laterally in relation to the barrier member and the safety gate interior space.

21. A safety gate according to claim 19 wherein the rotating assembly includes a bearing arrangement.

22. A combination of a safety gate arrangement and a mezzanine loading bay comprising:

(a) a mezzanine level disposed above a ground floor, the mezzanine level including a mezzanine edge defining a boundary between the mezzanine level and the ground floor;

(b) a support frame situated on the mezzanine level and having an inside support frame perimeter;

(c) a barrier member supported by the support frame and having an inside barrier member perimeter, wherein the inside support frame perimeter and the inside barrier member perimeter define an open interior space;

(d) the barrier member including an uppermost edge defining a top opening, the top opening providing unobstructed access into the interior space; and (e) a rotating assembly mounted to the support frame in operative engagement with the barrier member and adapted to rotate the barrier member about a substantially vertical axis between an open position and a closed position without obstructing access into the interior space to enable transport of a load into the interior space, wherein the safety gate arrangement does not include any structure disposed above the interior space.

23. A combination of a safety gate arrangement and a mezzanine loading bay comprising:

(a) a mezzanine level disposed above a ground floor, the mezzanine level including a mezzanine edge defining a boundary between the mezzanine level and the ground floor;

(b) a support frame situated on the mezzanine level and having an inside support frame perimeter;

(c) a barrier member supported by the support frame in movable engagement therewith and alternately rotatable about a substantially vertical axis between an open position and a closed position, the barrier member having an inside barrier member perimeter, wherein the inside support frame perimeter and the inside barrier member perimeter define an open interior space, and wherein the barrier member prevents access to the mezzanine edge when the barrier member is in the open position; and (d) the barrier member including an uppermost edge defining a top opening, wherein the support frame and the top opening provide unobstructed access into the interior space for transport of a load into the interior space, and wherein the safety gate arrangement does not include any structure disposed above the interior space.

* * * * *